US011519377B2

(12) United States Patent
Krause et al.

(10) Patent No.: US 11,519,377 B2
(45) Date of Patent: Dec. 6, 2022

(54) METHOD FOR ACTIVELY DAMPENING A START-UP RESONANCE OF A TORSIONAL DAMPER WHEN STARTING AN INTERNAL COMBUSTION ENGINE

(71) Applicant: Schaeffler Technologies AG & Co. KG, Herzogenaurach (DE)

(72) Inventors: Thorsten Krause, Bühl (DE); Kai Schenck, Offenburg (DE); Bertrand Pennec, Strassburg (FR)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/421,806

(22) PCT Filed: Dec. 10, 2019

(86) PCT No.: PCT/DE2019/101062

§ 371 (c)(1),
(2) Date: Jul. 9, 2021

(87) PCT Pub. No.: WO2020/147874

PCT Pub. Date: Jul. 23, 2020

(65) Prior Publication Data

US 2022/0099061 A1 Mar. 31, 2022

(30) Foreign Application Priority Data

Jan. 16, 2019 (DE) ..... 102019100968.5

(51) Int. Cl.
*F02N 11/08* (2006.01)
*F02N 15/10* (2006.01)

(52) U.S. Cl.
CPC ..... *F02N 11/0851* (2013.01); *F02N 15/10* (2013.01); *F02N 2200/021* (2013.01); *F02N 2200/022* (2013.01)

(58) Field of Classification Search
CPC ..... F02N 2200/021; F02N 2200/022; F02D 2250/28
See application file for complete search history.

(56) References Cited

U.S. PATENT DOCUMENTS 6,158,405 A 12/2000 Masberg et al.
6,365,983 B1 * 4/2002 Masberg ..... F02B 75/06 322/14
6,382,163 B1 * 5/2002 Murray ..... B60K 6/485 123/192.1
8,538,643 B1 9/2013 Wang et al.
8,903,577 B2 * 12/2014 Jalbout ..... B60W 10/08 180/65.285

(Continued)

FOREIGN PATENT DOCUMENTS

CN 1980807 A 6/2007
CN 102678317 A 9/2012

(Continued)

OTHER PUBLICATIONS

Deng Bin et al. "Simulation Model and Method for Active Torsional Vibration Control of an HEV" Applied Science MDPI, Nov. 20, 2018 (Nov. 20, 2018), XP055672744, pp. 1, 4, 11, 12, & 14.

*Primary Examiner* — Phutthiwat Wongwian
*Assistant Examiner* — Arnold Castro

(57) ABSTRACT

A method actively dampens a start-up resonance of a torsional damper when starting an internal combustion engine. The torsional damper (4) is fixed between an internal combustion engine (1) and a secondary side (5) of a torsional elasticity, and the internal combustion engine (1) is started using a starter generator (3) arranged on a side of the internal combustion engine (1) counter to the torsional elasticity. A counter excitation is applied to a torque generated by the starter generator (3) when the internal combustion engine (1) is started, which counter excitation is modulated on the basis of a parameter of the internal combustion engine (1) which changes when the internal combustion engine (1) is being started.

20 Claims, 4 Drawing Sheets

(56) References Cited

U.S. PATENT DOCUMENTS

| | | | | |
|---|---|---|---|---|
| 2002/0047417 | A1 | 4/2002 | Tebbe | |
| 2005/0216145 | A1* | 9/2005 | Bellinger | B60W 10/10 701/33.9 |
| 2007/0101965 | A1* | 5/2007 | Asahara | B60W 10/06 477/3 |
| 2012/0239237 | A1* | 9/2012 | Hashimoto | B60W 30/20 180/65.265 |
| 2018/0009430 | A1* | 1/2018 | Chung | B60K 6/48 |
| 2019/0031178 | A1* | 1/2019 | Liu | B60K 6/543 |
| 2019/0162255 | A1* | 5/2019 | Höche | F16D 48/08 |
| 2019/0195298 | A1* | 6/2019 | Höche | F16D 48/08 |
| 2019/0219111 | A1* | 7/2019 | Höche | F16D 48/08 |

FOREIGN PATENT DOCUMENTS

| | | | |
|---|---|---|---|
| CN | 102767441 | A | 11/2012 |
| CN | 102966716 | A | 3/2013 |
| CN | 103210226 | A | 7/2013 |
| CN | 103373358 | A | 10/2013 |
| CN | 103786727 | A | 5/2014 |
| CN | 104053898 | A | 9/2014 |
| CN | 108138869 | A | 6/2018 |
| CN | 108291520 | A | 7/2018 |
| CN | 110155021 | A | 8/2019 |
| CN | 111886150 | A | 11/2020 |
| DE | 10063457 | A1 | 6/2002 |
| DE | 10123037 | A1 | 11/2002 |
| DE | 102012201102 | A1 | 8/2012 |
| DE | 102015207640 | A1 | 10/2016 |
| EP | 1497151 | B1 | 4/2009 |
| GB | 2411938 | A | 9/2005 |
| JP | 11332581 | A | 12/1999 |
| JP | 2001248470 | A | 9/2001 |
| JP | 2002106629 | A | 4/2002 |
| JP | 2008121819 | A | 5/2008 |

* cited by examiner

METHOD FOR ACTIVELY DAMPENING A START-UP RESONANCE OF A TORSIONAL DAMPER WHEN STARTING AN INTERNAL COMBUSTION ENGINE

CROSS-REFERENCE TO RELATED APPLICATIONS

This application is the U.S. National Phase of PCT Appln. No. PCT/DE2019/101062 filed Dec. 10, 2019, which claims priority to DE 102019100968.5 filed Jan. 16, 2019, the entire disclosures of which are incorporated by reference herein.

TECHNICAL FIELD

The disclosure relates to a method for actively dampening a start-up resonance of a torsional damper when starting an internal combustion engine, wherein the torsional damper is fixed between the internal combustion engine and a secondary side of a torsional elasticity, and the internal combustion engine is started using a starter generator arranged on a side of the internal combustion engine counter to the torsional elasticity.

BACKGROUND

A method for operating a motor vehicle is known from EP 1 497 151 B 1, in which an internal combustion engine is started by a starter generator, wherein a clutch for temporarily connecting the starter generator and internal combustion engine is arranged between the starter generator and the internal combustion engine.

DE 10 2015 207 640 A1 discloses a drive train and a method for its operation, wherein the drive train has an internal combustion engine with a crankshaft and, on the output side of the crankshaft, a dual mass flywheel with a primary side and a secondary side that can be rotated to a limited extent against said primary side counter to the action of a spring device, wherein a starter generator is arranged in a belt pulley plane of the internal combustion engine. In order to avoid large angles of rotation between the primary and secondary disks of the dual mass flywheel when the internal combustion engine is being started, a starter is effectively arranged on the secondary side. This is intended to bypass a resonance range of the dual mass flywheel when the internal combustion engine is being started. Such an arrangement is very complex because, in addition to the starter generator, a further starter is required to drive the secondary side of the dual mass flywheel.

SUMMARY

It is desirable to provide a method for actively dampening a start-up resonance of a torsional damper when starting an internal combustion engine, which does not require additional hardware.

Such dampening is achieved by applying a counter excitation to a torque generated by the starter generator when the internal combustion engine is being started. The counter excitation is modulated on the basis of a parameter of the internal combustion engine which changes when the internal combustion engine is being started. By means of such a solution, which can be implemented using only software, the effects of the start-up resonance on the torsional elasticity are reduced. At the same time, both the resonances of the torsional damper, and any rotational irregularities, which the internal combustion engine excites due to compression and expansion torques during the starting process in order to set the crankshaft into operation, are reduced. This has the advantage that low-friction torsional elasticities can also be used in a drive train.

The counter excitation is advantageously modulated on the basis of a crankshaft angle with a harmonic excitation of the nth order of the internal combustion engine. The harmonic excitation of the nth order is superimposed on the torque of the starter generator. Such a counter excitation compensates for the resonant vibrations of the internal combustion engine and the torsional damper.

In one embodiment, the counter excitation is set on the basis of a speed of the internal combustion engine and/or a speed difference and/or rotation angle difference between the internal combustion engine and starter generator or internal combustion engine and transmission. The parameters used can be individually determined on the basis of the respective drive train.

In a variant, the torque of the starter generator is superimposed with a counter excitation designed as a sine function during the starting process of the internal combustion engine. This takes into account the fact that the rotational irregularities caused by the internal combustion engine are periodic even without ignition excitations, which is why they can be compensated particularly well by a counter excitation designed as a sine function.

In one embodiment, a nominal torque of the starter generator is exceeded during the starting process to superimpose the counter excitation on the torque of the starter generator. This can always be advantageously used when an electrical design of the starter generator allows the starter generator to be operated briefly in overload.

In an alternative, a mean torque of the starter generator is reduced during the starting process to superimpose the counter excitation on the torque of the starter generator. The consequence of this is that the starting process is slowed down. By reducing the mean torque of the starter generator, however, the counter excitation can be increased accordingly, so that the rotational irregularities of the internal combustion engine can be compensated particularly well.

In a further alternative, the counter excitation is reduced during the starting process in an upper speed range of the internal combustion engine. In this speed range of the internal combustion engine, which is close to the idling speed, the internal combustion engine no longer generates such high rotational irregularities.

In a further embodiment, a phase position of the counter excitation is shifted to take into account a rigidity of a belt drive arranged between the starter generator and the internal combustion engine. This enables the crankshaft angle to be achieved at the correct point in time by the counter excitation and thus a sufficient compensation of the start-up resonances can occur.

BRIEF DESCRIPTION OF THE DRAWINGS

An embodiment is explained in detail with reference to the figures shown in the drawing.

In the drawings.

DETAILED DESCRIPTION

Figure 1:
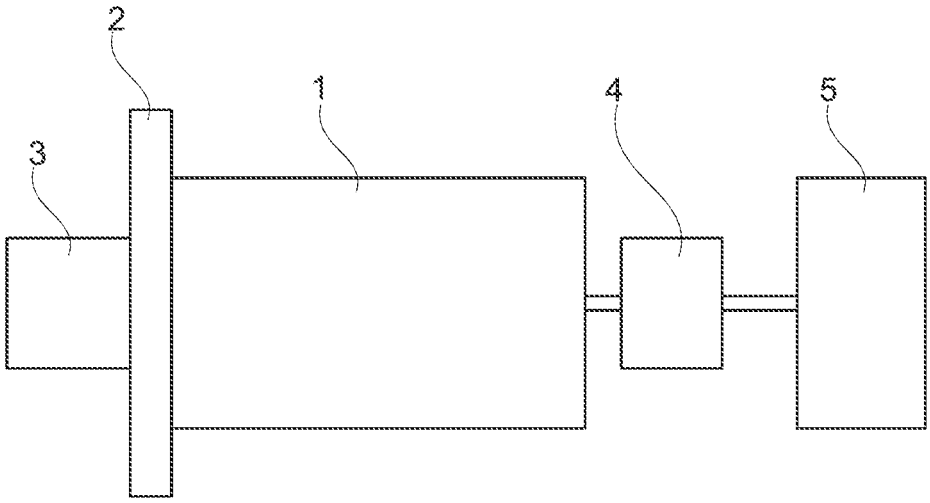
FIG. 1 shows a basic illustration of an internal combustion engine in a drive train.

FIG. 1 shows a basic illustration of an internal combustion engine in a drive train, in which the internal combustion engine 1 is coupled to a starter generator 3 via a belt drive 2. On the counter side of the internal combustion engine 1, a torsional damper 4 is connected, which in turn is coupled to a secondary side 5 of a dual mass flywheel. The dual mass flywheel is an example of torsional elasticity.

Figure 2:
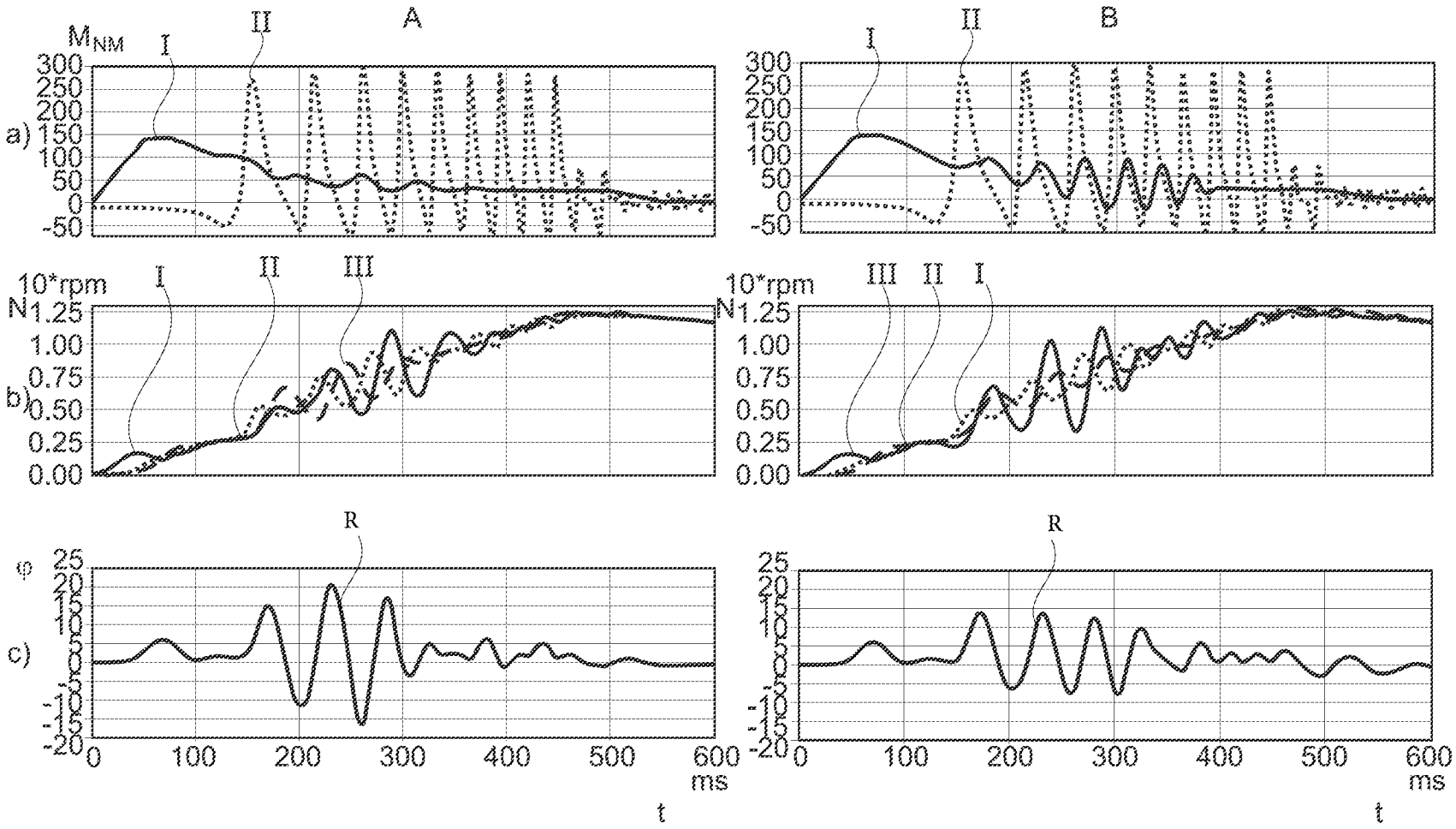
FIG. 2 shows an exemplary embodiment of the method.
Figure 3:
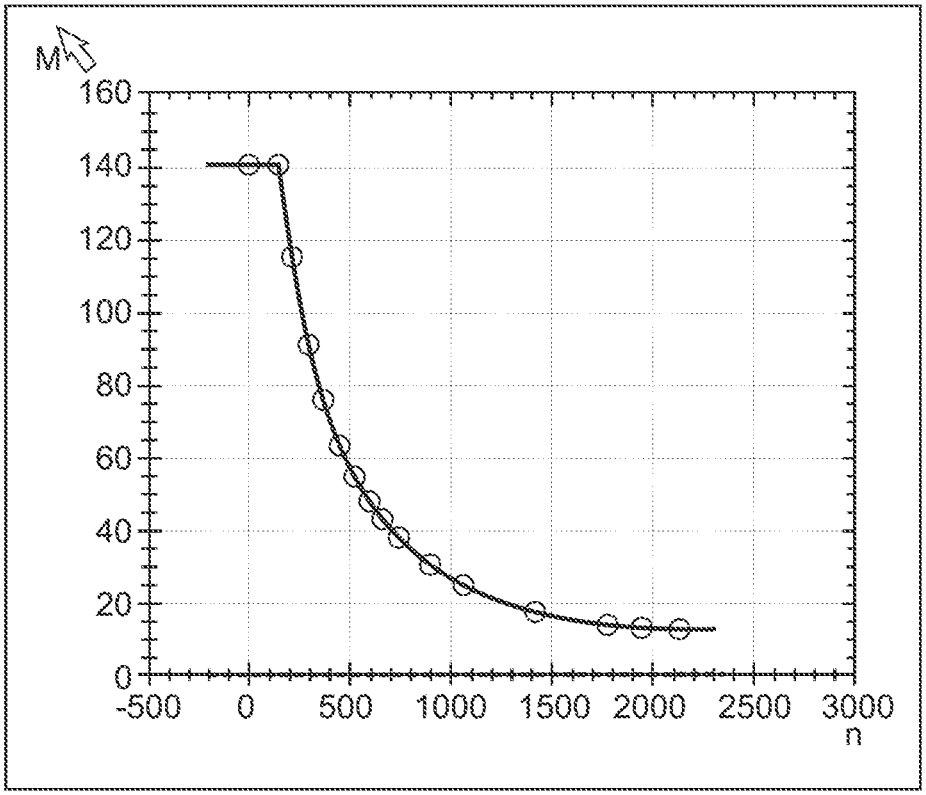
FIG. 3 shows a representation of a torque of the starter generator without counter excitation.

FIG. 2 shows an exemplary embodiment of the method, which shows the internal combustion engine 1 being started by the starter generator 3. Column A shows the processes without superimposing of a counter excitation on the torque of the starter generator 3, while column B shows the behavior of the system with the superimposing of the counter excitation on the torque of the starter generator 3. In row a, the torque M is shown on the basis of the time t. Row b shows the speed n over time t, while row c shows the angle of rotation φ of the dual mass flywheel. In all of these diagrams, curve I characterizes the generator behavior, curve II the behavior of the internal combustion engine 1 and curve III the behavior of the secondary side 5 of the dual mass flywheel.

In section Aa, it can be seen that the starter generator 3 initially expends a high torque in order to start the internal combustion engine 1, which torque weakens over time. The internal combustion engine 1 again starts at a torque of 0 until the torque of the starter generator 3 becomes effective and ignitions of the internal combustion engine 1, which are shown as peaks, are realized. From section Ba, it can be seen that the torque of the starter generator 3 is much more uneven due to the superimposing of a counter excitation, wherein a maximum of the torque of the internal combustion engine 1 and the modulated torque of the starter generator 3 and/or a minimum of the torque of the internal combustion engine 1 and the starter generator 3 are always be close to each other. In the present case, the torque of the starter generator 3 during the starting process of the internal combustion engine 1 is superimposed with a sine function that is dependent on the crankshaft angle in the respective engine order, preferably the first harmonic of the main excitation of the internal combustion engine 1. As a result, the speed of the starter generator 3 is increased over the time t in order to reduce the speed of the internal combustion engine 3 and also of the secondary side 5 of the dual mass flywheel (Fig. Bb). The effect of this is that the angle of rotation φ of the secondary side 5 of the dual mass flywheel, as shown in section Bc, is reduced compared to the method without counter excitation (section Ac). The resonances R are significantly reduced with the aid of the method.

There are various ways in which the starter generator 3 can be controlled during superimposing by a counter excitation. The starter generator 3 can thus exceed its nominal torque in some areas, wherein the starter generator 3 is operated briefly in overload.

Figure 4:
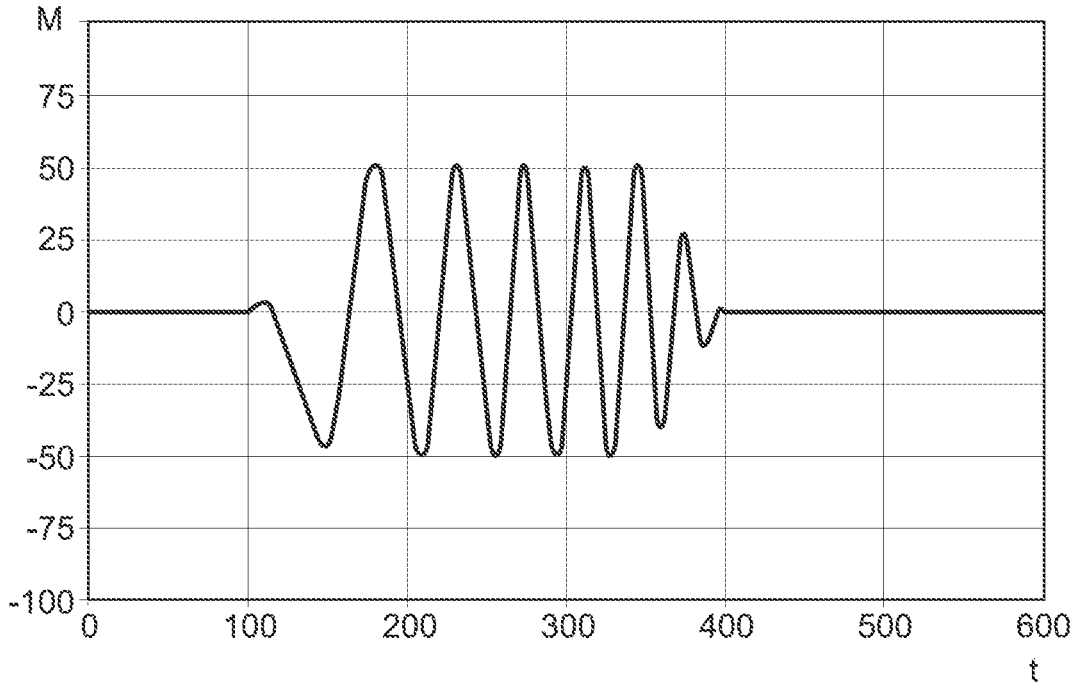
FIG. 4 shows a diagram of the torque curve with active dampening of the start-up resonance of a torsional damper.

In an alternative, the mean torque of the starter generator 3 is reduced, as shown in FIG. 4. The torque curve for actively dampening the start-up resonance of the torsional damper 4 is shown over the time t, at which the torque curve corresponds to the amplitude*sin (2×crankshaft angle+phase).

Another possibility allows the starting process to be carried out in an upper speed range of the internal combustion engine, in which the amplitude of the counter excitation is reduced. This can be achieved because less counter excitation is necessary in such a high frequency range of the start-up resonance. It should always be assumed that, when the internal combustion engine 1 rotates slowly, the torque and the counter excitation have a lower frequency, whereas they increase in the case of a faster rotating internal combustion engine 1.

In order to optimize the effectiveness of the counter excitation, the phase position and/or the amplitude of the superimposed sine function is shifted, which means that a rigidity of the belt drive 2 is also taken into account. This ensures that the maximum or minimum of the modulated torque of the starter generator 3 is applied to the crankshaft of the internal combustion engine 1 at the correct point in time. Setting the counter excitation on the basis of the crankshaft angle is the simplest way of actively dampening the start-up resonance of the torsional damper 4. However, it is also conceivable to set this on the basis of a speed, a speed difference or a rotation angle difference between the internal combustion engine and generator or internal combustion engine and transmission.

LIST OF REFERENCE SYMBOLS

1 Internal combustion engine
2 Belt drive
3 Starter generator
4 Torsional damper
5 Secondary side of a dual mass flywheel

The invention claimed is:

1. A method for actively dampening a start-up resonance of a torsional damper when starting an internal combustion engine, comprising:

fixing the torsional damper between the internal combustion engine and a secondary side of a torsional elasticity, starting the internal combustion engine using a starter arranged on a side of the internal combustion engine opposite the torsional elasticity, applying a counter excitation to a torque generated by the starter while the internal combustion engine is started, which counter excitation is modulated based on a parameter of the internal combustion engine which changes when the internal combustion engine is being started, and shifting a phase of the counter excitation to take into account a rigidity of a belt drive arranged between the starter and the internal combustion engine.

2. The method according to claim 1, wherein the parameter of the internal combustion engine is a crankshaft angle with a harmonic excitation of the nth order of the internal combustion engine.

3. The method according to claim 1, further comprising setting a magnitude of the counter excitation based on a speed of the internal combustion engine and/or a speed difference and/or rotation angle difference between the internal combustion engine and starter or internal combustion engine and transmission.

4. The method according to claim 1, wherein the counter excitation is a sine function.

5. The method according to claim 1, further comprising exceeding a nominal torque of the starter during the starting process to superimpose the counter excitation on the torque of the starter.

6. The method according to claim 1, further comprising reducing a mean torque of the starter during the starting process to such that superposition of the counter excitation does not exceed a maximum value.

7. The method according to claim 1, further comprising reducing a magnitude of the counter excitation during the starting process in an upper speed range of the internal combustion engine.

8. A powertrain comprising:

an internal combustion engine;

a torsional damper fixed between the internal combustion engine and a secondary side of a torsional elasticity; and a starter coupled to the engine via a belt; wherein a counter excitation is applied to a torque generated by the starter while the internal combustion engine is being started, which counter excitation is modulated based on a crankshaft angle of the internal combustion engine.

9. The powertrain according to claim 8, wherein a magnitude of the counter excitation is set on the basis of a speed of the internal combustion engine.

10. The powertrain according to claim 9, wherein the magnitude of the counter excitation is reduced during the starting process in an upper speed range of the internal combustion engine.

11. The powertrain according to claim 8, wherein a magnitude of the counter excitation is set on the basis of a speed difference between the internal combustion engine and the starter.

12. The powertrain according to claim 8, wherein a magnitude of the counter excitation is set on the basis of a rotation angle difference between the internal combustion engine and the starter.

13. The powertrain according to claim 8, wherein the counter excitation is a sine function.

14. The powertrain according to claim 8, wherein superposition of the counter excitation results in a nominal torque of the starter being exceeded during the starting process.

15. The powertrain according to claim 8, wherein a mean torque of the starter is reduced during the starting process such that superposition of the counter excitation does not result in exceeding a maximum value.

16. The powertrain according to claim 8, wherein a phase of the counter excitation is shifted to take into account a rigidity of the belt.

17. A powertrain comprising:

an internal combustion engine;

a torsional damper fixed between the internal combustion engine and a secondary side of a torsional elasticity; and a starter coupled to the engine via a belt; wherein a counter excitation is applied to a torque generated by the starter while the internal combustion engine is being started, which counter excitation is modulated based on a parameter of the internal combustion engine which changes when the internal combustion engine is being started.

18. The powertrain according to claim 17, wherein a magnitude of the counter excitation is set based on a speed of the internal combustion engine.

19. The powertrain according to claim 17, wherein a magnitude of the counter excitation is set based on at least one of a speed difference between the internal combustion engine and the starter and a rotation angle difference between the internal combustion engine and the starter.

20. The powertrain according to claim 17, wherein a phase of the counter excitation is shifted to take into account a rigidity of the belt.

* * * * *